US005103697A

United States Patent [19]

Masbaum

[11] Patent Number: 5,103,697

[45] Date of Patent: Apr. 14, 1992

[54] QUICK ADJUST WRENCH WITH POSITIVE POSITIONING

[76] Inventor: Thomas P. Masbaum, 4938 W. Irving Park Rd., Chicago, Ill. 60641

[21] Appl. No.: 661,062

[22] Filed: Feb. 26, 1991

[51] Int. Cl.[5] ..... B25B 13/12

[52] U.S. Cl. ..... 81/154; 81/148; 81/150

[58] Field of Search ..... 81/154, 149, 148, 150

[56] References Cited

U.S. PATENT DOCUMENTS

| | | | |
|---|---|---|---|
| 1,004,561 | 10/1911 | Fitzgerald . | |
| 1,389,487 | 8/1921 | Cassel . | |
| 1,397,214 | 1/1921 | Hose . | |
| 1,427,918 | 9/1922 | Stauffer . | |
| 1,481,250 | 11/1924 | Bohn . | |
| 1.511,526 | 10/1924 | Strickler . | |
| 1,514,017 | 11/1924 | Schroeder . | |
| 2,722,150 | 11/1955 | Green . | |
| 2,948,175 | 8/1960 | Bonkowski | 81/154 |
| 4,903,556 | 2/1990 | Spirov et al. | 81/154 |

*Primary Examiner*—Bruce M. Kisliuk
*Assistant Examiner*—Lawrence Cruz

[57] ABSTRACT

A adjustable open end type wrench having a solid jaw guide that prevents slippage of the movable jaw and relative movement between the jaws thereby virtually eliminating the tendency of such wrenches to loosen under load. The arrangement of this invention replaces the usual worn gear with a wedge and an arrangement that joins the jaw and the wedge through a tension member that passes through or straddles the jaw guide. The jaw guide extends in a direction generally perpendicular to the gripping surfaces of the jaws. The action of the jaw on the wedge pulls the wedge toward the guide and places the guide in compression. Compression on the guide increases the clamping action of the jaw and the wedge and keeps the jaw in place. A relatively simple wedge arrangement will provide the necessary clamping action. Consequently, this invention provides a simple adjustable wrench design wherein slippage of the wedge and consequent loosing of the wrench is essentially eliminated.

16 Claims, 2 Drawing Sheets

QUICK ADJUST WRENCH WITH POSITIVE POSITIONING

BACKGROUND OF THE INVENTION

1. Field of the Invention

This invention relates generally to adjustable wrenches wherein wedge elements are used to provide quick adjustment. This invention is most suitable for quick adjustable wrenches of the type wherein the jaws extend longitudinally from the handle. This type of wrench is generally referred to as an adjustable open ended wrench.

2. Description of the Prior Art

In the most common type of adjustable wrench a worm gear and a journaled jaw member interact to change the relative location of the fixed and movable jaws. A pin rotatably holds the worm gear in a slot that extends through the handle of the wrench. The worm gear contacts a journaled rear portion of the movable jaw. The movable jaw slides in a groove defined by the handle to a location controlled by the worm gear. U.S. Pat. No. 2,722,150 shows the general arrangement of this type of wrench. The worm gear arrangement of this typical wrench design always leaves some play between the jaws. This play results in the wrench sometimes slipping under pressure and thus detracting from the reliability of such devices.

Many adjustable wrench designs have been proposed that attempt to improve the adjustability and reliability of such wrenches. Such wrench designs include U.S. Pat. No. 1,397,214 wherein a slot in the handle of wrench retains a grooved wedge that a spring biases toward a slidably mounted movable jaw having complementary grooves for holding the jaw in position. The movement of the wedge is relatively quick which in turn allows quick adjustment of the wrench.

A number of other quick adjustment wrench designs use a series of wedges or ramps to quickly adjust the position of the movable jaw. Basic wedge designs in adjustable wrenches are well known and depicted in U.S. Pat. Nos. 1,511,526, 1,481,250, 1,004,561, 1,514,017 and 1,427,918. Examples of wedge designs adapted for use in open adjustable type wrenches are shown in U.S. Pat. Nos. 2,948,175 and 1,389,487 wherein a wedge cooperates with an inclined surface to move the wedge forward in compression against an opposing surface of the movable jaw. Pressure exerted by the wedge locks the jaw in place until displacement of the wedge along the surface of the ramp releases the jaw. Another wedge type wrench design is shown in U.S. Pat. No. 4,903,556 where a wedge is contained in an inclined slot that extends through a handle portion of the wrench. The wedge has a flat surface on one side that acts against a surface of the slot and a tapered surface that acts against a tapered surface on the back of a movable jaw.

Although the wedge type wrench designs offer quick adjustment and generally less play than the worm gear type wrenches, the wedge type designs can still slip under heavy load. In these wedge type designs the wedge acts against the walls of the slot. Pressure on the wedge causes the wedge to move or give slightly. This small amount of give still results in slippage of the wrench that deforms nuts and bolts and can cause injury to the user.

One object of the invention is to provide a quickly adjustable wrench of the open adjustable type that has a reduced amount of play between the jaws relative to other wedge type open adjustable wrench designs.

Another object of this invention is to provide a quickly adjustable open type wrench having a simplified wedge design.

It has been discovered that the problem with the other open adjustable wrench designs that use a wedge in a slot for quick adjustment is that the wedges are always arranged in a way that will tend to enlarge the slot. As this enlarging occurs the wedge can slip slightly or a small relative movement of the jaws will occur, thereby causing the wrench to become loose.

BRIEF DESCRIPTION OF THE INVENTION

In this invention arranging the wrench to clamp the movable jaw and wedge about a solid jaw guide prevents slippage of the movable jaw and relative movement between the jaws thereby virtually eliminating the tendency of such wrenches to loosen under load. The arrangement of this invention joins the jaw and the wedge through a tension member that passes through or straddles the jaw guide. The jaw guide extends in a direction generally perpendicular to the gripping surfaces of the jaws. The action of the jaw on the wedge pulls the wedge toward the guide and places the guide in compression. Compression on the guide increases the clamping action and keeps the jaw in place. A relatively simple wedge arrangement will provide the necessary clamping action. Consequently, applicant has discovered a simple adjustable wrench design wherein slippage of the wedge and consequent loosening of the wrench is essentially eliminated.

Moreover, this new arrangement provides a structural design that increases the clamping action of the wedge when the wrench applies torque to an object. Applying a torque with the wrench tends to separate the jaws thereby developing a transverse force and force couple between the jaws. The wedge arrangement of this invention causes both the transverse force and force couple to tighten the clamping action of the wedge. Conversely in the open ended wrench designs of the prior art both the transverse force and force couple served to loosen the wedge.

Accordingly in one embodiment this invention is an adjustable wrench. The wrench includes a handle portion and a head portion formed at one end of the handle portion, the head portion has a fixed jaw with a gripping face extending outwardly from the head portion and a jaw guide located adjacent to the head and comprising a solid member having first and second guide surfaces with one of the surfaces located on the front of the guide and the other surface located on the back of the guide. A wedge element having first and second divergent wedge surfaces is disposed such that the first wedge surface is in sliding contact with the first guide surface. The wrench also includes a movable jaw having a gripping face disposed substantially parallel to the gripping face of the fixed jaw, a tongue extending transversely to the jaw guide and cooperating with the jaw guide for sliding motion along the length of the jaw guide and first and second opposing jaw surfaces associated with opposite ends of the tongue and disposed such that the first jaw surface is in sliding contact with the second wedge surface and the second jaw surface is in sliding contact with the second guide surface.

In another embodiment this invention is a quickly and rigidly adjustable wrench comprising: a handle portion and a head portion formed at one end of the handle portion, the head portion having a fixed jaw with a gripping face extending outwardly from the head portion in a direction generally longitudinal to the handle and a jaw guide comprising two parallel bars located adjacent and extending perpendicularly with respect to the head and the bars having a front surface facing the head portion of the wrench and extending perpendicularly from the head portion of the wrench and a back surface facing the handle end of the wrench and tapered away from and toward the handle end of the wrench at an angle of from about 0.5° to 2.5°; a tapered wedge having first and second divergent wedge surfaces defining an included angle of about 5° to 20° between the wedge surfaces, disposed such that the first wedge surface is in sliding contact with the back surface of the bars, and a slot extending through the wedge having an opening on the first and second wedge surfaces; a movable jaw having a gripping face disposed substantially parallel to the gripping face of the fixed jaw, a single tongue having a proximate end fixed to the movable jaw and a distal end located opposite the movable jaw, the tongue extending between and transversely to the bars of the jaw guide, through the slot and cooperating with the bars for sliding motion relative thereto and a first jaw surface located orthogonally to the gripping faces of the jaws, extending outwardly from the sides of the tongue at the proximate end of the tongue, and disposed in sliding contact with the front surface of the bars; a pin extending transversely outward from the sides of the tongue at the distal end of the tongue disposed for contact with the second wedge surface; and, means for gripping the tapered wedge to move the wedge and release the movable jaw.

Additional embodiments, details, and aspects of this invention are set forth in the following detailed description of the invention.

DETAILED DESCRIPTION OF THE INVENTION

Figure 1:
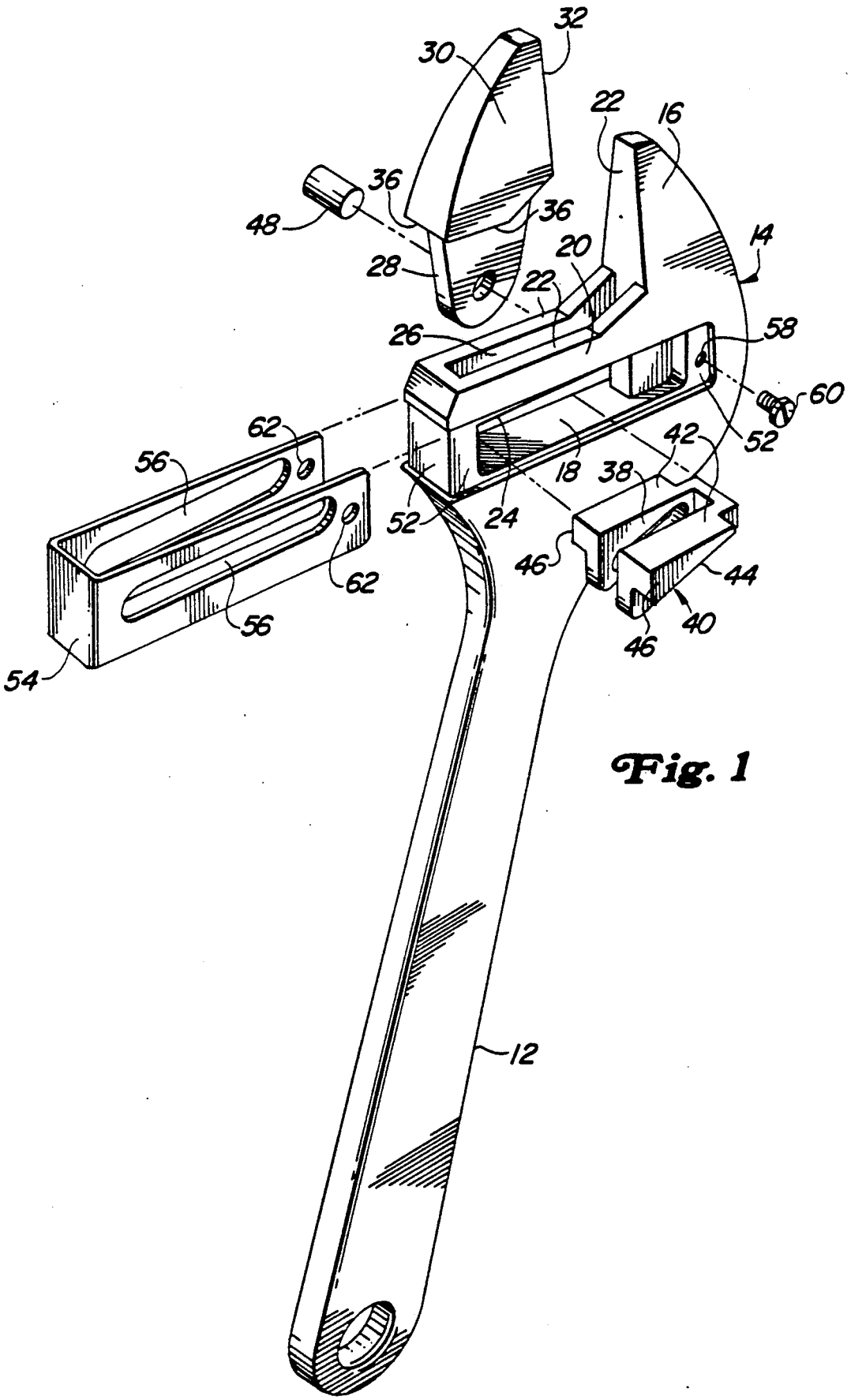
FIG. 1 is an exploded isometric view of a wrench of this invention.
Figure 2:
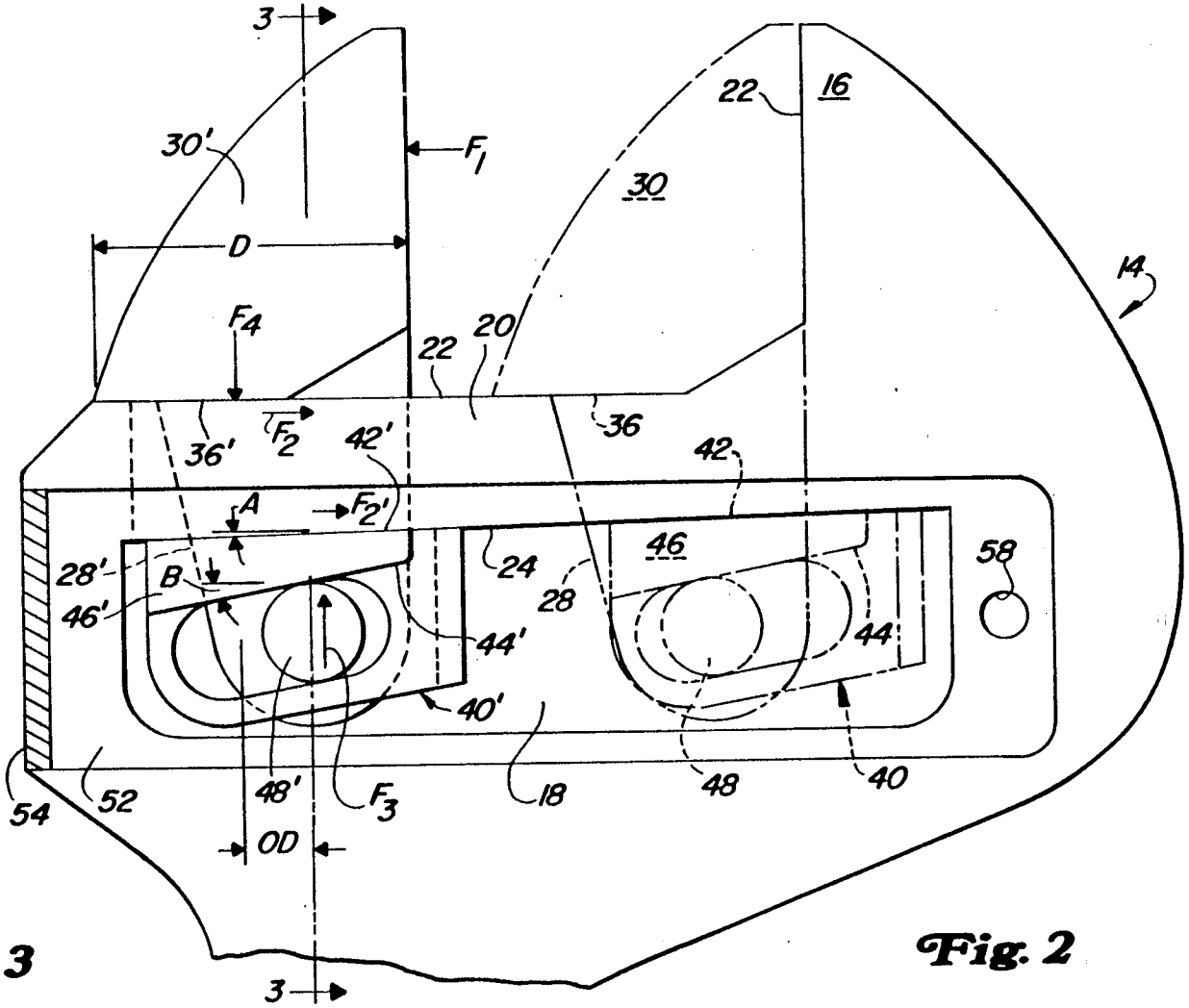
FIG. 2 is an assembled view showing a cross section of the wrench head in an open and closed position.

An adjustable wrench 10 in accordance with this invention is shown in FIGS. 1 and 2. The wrench includes a handle portion 12 and a head portion 14 formed at one end of the handle that provides a fixed jaw 16. A flat face 22 of the head 16 provides a gripping surface. A jaw guide 20 projects in a generally transverse direction away from face 22. The head 14 defines a window 18 in the head portion located to the inside of guide 20. Guide 20 has a guide surface 22 on an outer surface of head 14 and a guide surface 24 bordering window 18. Guide 20 comprises two parallel guide bars separated by a slot 26 extending across the width of the guides between the window 18 and surface 22.

Slot 26 has generally parallel sides that receive a tongue 28 of a movable jaw 30. The movable jaw has a flat face 32 that provides a gripping face which cooperates with face 22 of the fixed jaw. Guide surfaces 36 at the back of movable jaw 30 extend outwardly at the junction of tongue 28 with jaw 30 and cooperate with guide surface 22 to hold face 32 generally parallel with face 22 when tongue 28 is positioned slot 26.

When positioned in slot 26 tongue 28 extends past guide surface 24 and into a channel 38 of a wedge block 40. Wedge block 40 has wedge surfaces 42 that slide along and cooperate with guide surfaces 24. Opposite wedge surfaces 42 the wedge block defines tapered surfaces 44. Tongue 28 extends past surface 44 and traps wedge block 40 between surfaces 24 and a pin 48. Tongue 28 defines a hole 50 that receives pin 48. Pin 48 functions to provide an additional jaw surface. Wedge block 40 has a greater width than head 14 so that transverse sides 46 project outwardly through window 18 past the sides of head 14.

A recess 52 defined by the head extends around the sides and bottom of head 14 and receives a U-shaped sleeve 54 that retains pin 48. Pin retainer 54 has slots 56 through which wedge sides 46 extend when retainer 54 wraps around wrench head 14. A threaded hole 58 receives a screw 60 that passes through a hole 62 in the top of retainer 54 to hold the retainer in place.

To use the wrench the surface 22 of the fixed jaw is placed against an object for gripping. The user adjusts the wrench by grasping the sides of 46 of wedge block 40 and sliding the block 40 toward the fixed jaw. As the wedge block moves toward the fixed jaw contact of pin 48 with the tapered surfaces brings surface 32 of the movable jaw into contact with an opposing side of the object. Once the movable jaw contacts the object it stops and continued pressure on the wedge block locks the movable jaw into place against the object by the clamping action of jaw surface 36 and wedge surfaces 42 on guide 20. The relative location of the wedge block and movable jaw are shown in FIG. 2 where the elements with prime marks represent the relative position of the wedge block and movable jaw when the wrench is in an unlocked position and the primed numbers show the elements in a locked position.

Although not wishing to be bound by any theory, it is noted that when the wrench grips an object, applying force to wrench handle 12 tends to force the jaws apart. The resulting downward pressure, as indicated on FIG. 2 by $F_1$, increases the clamping action of the jaw and wedge on guide 20. As the object pushes against the movable jaw, force $F_1$ acts downwardly when the wrench is oriented as shown in FIG. 2. Frictional forces $F_2$ and bearing forces $F_2$ acting along the guide resist force $F_1$. The eccentricity of $F_1$ from the guide 20 creates a moment about the guide that results in a force couple, idealized by $F_3$ and $F_4$, that acts against the movable portion of the guide and the wedge in the manner as shown in FIG. 2. Force $F_1$ also acts downwardly through pin 48 which increases the clamping action of the wedge and movable jaw on the guide. In addition, the action of forces $F_3$ and $F_4$ also increases the clamping force exerted on guide.

Since all of the clamping forces act compressively on the guide there is virtually no deformation of the guide from the clamping forces. Thus window 18 does not open under load and rotation of the movable jaw 30 is reduced. The guide will have to resist shear forces created by force $F_1$; however, the deformation produced by resisting such loadings will be substantially less than the deformation associated with opening of the slot in the prior art arrangements.

This invention also permits the jaw guide to be a simple solid member. The jaw guide can include one or more of such solid members. No special form is needed for the jaw guide, any simple cross section can be used for the guide. Preferably the cross section of the guide members is convex, and more preferably square or rectangular, in cross section. It is particularly advantageous that the guide of this invention needs no dove tail or other type of complex slot arrangement as part of the guide design.

The use of a movable jaw having a relatively narrow depth D will tend to increase the magnitude of clamping forces $F_3$ and $F_4$. However, any increase in clamping force for a narrow depth movable jaw will be offset by the higher shear forces imposed on the guide as a result of the higher clamping forces.

The effective offset distance between the force couple $F_3$ and $F_4$ also controls the clamping force. FIG. 2 indicates this distance as OD. As OD decreases the clamping force increases. However, as in the case of jaw length to jaw width, the benefit of higher clamping forces is offset by increased shear forces that tend to deform the guide. Consequently, the ratio of OD to D is usually at least 50%.

Certain aspects of the wedge block are important to the wrench function. There must be means for grasping the wedge block and unlocking the movable jaw. With the wedge block illustrated in the Figures, the user unlocks the movable jaw by sliding the wedge block away from the fixed jaw. Sliding the wedge block away from the jaw releases pin 48 and allows the movable jaw to move.

In order to permit locking and unlocking of the movable jaw, the wedge block and the surface 24 must have the right taper. In order for the wrench to lock the guide surface that is in contact with the wedge block, i.e. guide surface 24, must have a small angle. This angle, labeled A on FIG. 2 is usually in a range of from 0.5° to 2.5°, with an angle of 1.5° being preferred. Smaller angles A are generally preferred to provide better locking of the movable jaw; however a smaller angle requires additional wedge block movement to lock the movable jaw. The divergent surfaces of the wedge block, i.e. surfaces 42 and 44, also define a small included angle, labeled B in FIG. 2, which is needed for the movable jaw to lock and release. Angles in the range of from 5 to 20 degrees have been found to work but wedge angles in the range of 8° to 12° are particularly preferred. It has been found that too small of an angle B will jam the wedge and prevent easy release of the movable jaw while too large of an angle will hinder locking of the movable jaw and can result in its sliding under load. The wedge block design pictured in FIGS. 1 and 2 shows the wedge block having only the back side tapered at an angle B of 10 degrees.

Apart from the contact surfaces, taper angle, and providing means for gripping, other aspects of the jaw and wedge block configuration are not important. Although the drawing shows the means for gripping as comprising extended sides 46, a number of other arrangements can be provided for allowing gripping of the wedge block. For example, The sides of slot 18 can be left open to simply grab a wedge that is flush with the sides of the wrench. Such an arrangement would eliminate the sleeve for keeping retaining pin 48 in place. Alternately any suitable means can be employed to hold such a pin in place. In fact, pin 48 can be eliminated altogether as long as some form of stop is provided at the back of tongue to act against the back side of the wedge.

Or, the wedge block can be in the form of a spiral cam pivotally supported by the pin. In such an arrangement the cam would have a lever for locking and unlocking the movable jaw.

Moreover, those skilled in the art will be aware of many variations in the design of the wrench that can be employed to accomplish the same results as those obtained by the wrench depicted in FIGS. 1 and 2. For instance, The wedge need not be in the slot at all. A pin or similar stop at the back of tongue 28 can act directly against the inner surface of the guide and the wedge can act between the movable jaw and the outer surface of the guide. Furthermore, a pair of tongue or webs can replace the single tongues and straddle a solid guide bar in place of having a slot between two guide bar sections as shown in FIGS. 1 and 2.

Figure 3:
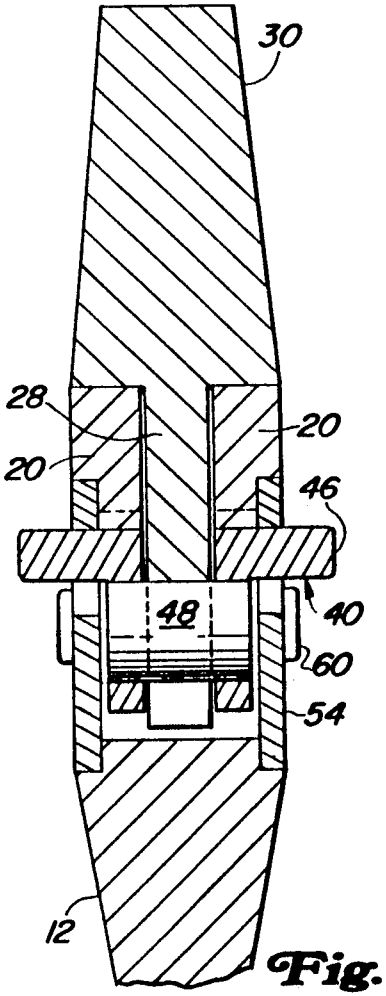
FIG. 3 is a cross sectional view of a the wrench in FIG. 2 taken across section 3—3.

FIG. 3 depicts the cross section of wrench of FIGS. 1 and 2 wherein the guides straddle the tongue of the movable jaw. Such an arrangement is readily changed to one in which the there is a front wedge block and a solid guide bar. In such an arrangement a movable jaw would define a pair of webs that straddle a solid guide bar formed as part of a wrench handle. The wrench handle would define a slot between itself and the solid guide bar. A pin would be fastened to webs and extend through slot to secures the jaw to the wrench handle. The webs would also straddle a wedge block which is trapped between the base section of the webs and the front of the guide. The wedge block would have the same angle as previously defined and the front of the guide would incorporate the angle A. Such a wrench will function in essentially the same manner as the wrench described in conjunction with FIGS. 1 and 2.

The description of this invention in the context of a limited number of specific embodiments is not meant to limit this scope of the claims to the details disclosed herein.

I claim:

1. An adjustable wrench comprising:

a handle portion and a head portion formed at one end of said handle portion, said head portion having a fixed jaw extending outwardly from said head portion, said jaw having a gripping face and a jaw guide located adjacent to said head and comprising a solid member having first and second divergent guide surfaces with one of said surfaces located on the front of said guide and the other surface located on the back of said guide;

a wedge element having first and second divergent wedge surfaces disposed such that said first wedge surface is in sliding contact with said first guide surface; and, a movable jaw having a gripping face disposed substantially parallel to the gripping face of said fixed jaw, a tongue extending transversely to said jaw guide and cooperating with said jaw guide for sliding motion along the length of said jaw guide and first and second opposing jaw surfaces associated with opposite ends of said tongue and disposed such that said first jaw surface is in sliding contact with said second wedge surface and said second jaw surface is in sliding contact with said second guide surface.

2. The wrench of claim 1 wherein said wrench is an open end adjustable type wrench and said jaws extend generally longitudinally from said handle.

3. The wrench of claim 1 wherein said wedge element is located on an opposite side of said jaw guide from said gripping face of said movable jaw.

4. The wrench of claim 1 wherein one of said first or second jaw surface comprises a portion of a pin extending transversely through said tongue.

5. The wrench of claim 1 wherein said wedge element has opposing sides located orthoganolly to said first and second wedge surfaces that extend transversely outward for gripping and moving said wedge.

6. The wrench of claim 1 wherein said jaw guide comprises two parallel guide bars, said guide bars are spaced apart to provide a slot, and said tongue is located in said slot.

7. The wrench of claim 1 wherein said first and second divergent wedge surfaces are on opposite sides of said wedge element.

8. The wrench of claim 1 wherein said wedge element comprises a cam and said cam pivots into contact with said first jaw surface.

9. The wrench of claim 4 wherein said wedge element comprises a cam and said cam pivots on said pin and said pin is located on the opposite side of said jaw guide from said gripping face of said movable jaw.

10. The wrench of claim 1 wherein said first and second divergent sides define an included angle in a range of 5° to 20°.

11. The wrench of claim 1 wherein said first and second divergent guide surfaces define an included angle of 0.5° to 2.5°.

12. A quickly adjustable wrench comprising:

a handle portion and a head portion formed at one end of said handle portion, said head portion having a fixed jaw with a gripping face extending outwardly from said head portion in a direction generally longitudinal to said handle and a jaw guide comprising two parallel bars located adjacent and extending in generally perpendicular direction with respect to said head, and said bars having a front surface facing the head portion of said wrench and a back surface facing the handle end of said wrench;

a tapered wedge having first and second divergent wedge surfaces disposed such that said first wedge surface is in sliding contact with said back surface of said bars and a slot extending through said wedge having an opening on said first and second wedge surfaces;

a movable jaw having a gripping face disposed substantially parallel to the gripping face of said fixed jaw, a tongue having a proximate end fixed to said movable jaw and a distal end located opposite said movable jaw, said tongue extending between and transversely through said bars of said jaw guide, through said slot and cooperating with said bars for sliding motion relative thereto and a first jaw surface located orthoganolly to said gripping faces of said jaws, extending outwardly from said proximate end of said tongue, and disposed in sliding contact with the front surface of said bars;

a pin extending transversely outward from the distal end of said tongue disposed for contact with said second wedge surface; and, means for gripping said tapered wedge to move said wedge and lock or release said movable jaw.

13. The wrench of claim 12 wherein said head portion has a recess for receiving a U-shaped sleeve and said sleeve retains said pin in said slot.

14. The wrench of claim 13 wherein said sleeve defines a pair of long slots on its opposite legs and said wedge has transversely extended sides that project through said long slots.

15. The wrench of claim 14 wherein said wedge surfaces define an included angle of 5° to 20°.

16. The wrench of claim 15 wherein said back bar has a 0.5° to 2.5° taper for increasing the width of the jaw guide as its distance from said fixed jaw increases.

* * * * *